US007056385B2

(12) United States Patent
Likosar

(10) Patent No.: US 7,056,385 B2
(45) Date of Patent: Jun. 6, 2006

(54) PAPER DISPENSER FOR OPTIONAL DELIVERY OF SATURATED OF DRY PAPER

(75) Inventor: Ferdinand Likosar, Im Wingert 34, Bludesch (AT) D-6719

(73) Assignees: Ferdinand Likosar, Bludesch (AT); Juliane Likosar, Bludesch (AT)

( * ) Notice: Subject to any disclaimer, the term of this patent is extended or adjusted under 35 U.S.C. 154(b) by 39 days.

(21) Appl. No.: 10/638,507

(22) Filed: Aug. 11, 2003

(65) Prior Publication Data

US 2004/0178299 A1 Sep. 16, 2004

(30) Foreign Application Priority Data

Mar. 13, 2003 (DE) ..... 103 10 944

(51) Int. Cl.
*B05C 1/08* (2006.01)

(52) U.S. Cl. ..... 118/249; 118/262; 221/45; 242/570

(58) Field of Classification Search ..... 118/264, 118/420, 423, 249, 262; 221/45; 242/570
See application file for complete search history.

(56) References Cited

U.S. PATENT DOCUMENTS

| | | | | |
|---|---|---|---|---|
| 3,025,829 | A * | 3/1962 | Smith | 118/221 |
| 4,747,365 | A * | 5/1988 | Tusch | 118/221 |
| 5,951,762 | A * | 9/1999 | Shangold et al. | 118/405 |
| 6,319,318 | B1 * | 11/2001 | Pekarek et al. | 118/249 |
| 6,547,881 | B1 * | 4/2003 | Klockner | 118/264 |

FOREIGN PATENT DOCUMENTS

DE 34 04 164 8/1985

* cited by examiner

*Primary Examiner*—Laura Edwards
(74) *Attorney, Agent, or Firm*—Baker & Daniels

(57) ABSTRACT

A paper dispenser for the optional distribution of saturated or dry paper from a paper roll or a folded paper sheet. A container filled with fluid is arranged in a housing from which the fluid is conveyed against the paper sheet to be moistened and is activated by a feed drive. In order achieve a more operationally secure transport of the paper sheet the intention is for the paper dispenser to have a hand-operated conveyor apparatus for the conveyor drive of the paper sheet. The fluid is conveyed from one of the extraction cylinders submerged in the fluid bath to one of the transfer cylinders loading onto one of the extraction cylinders, which is arranged on at least one side of the paper sheet.

3 Claims, 3 Drawing Sheets

PAPER DISPENSER FOR OPTIONAL DELIVERY OF SATURATED OF DRY PAPER

BACKGROUND OF THE INVENTION

The invention concerns a paper dispenser with saturated paper that may be used alternately to moisten a paper sheet or extract the paper sheet dry.

DE 34 04 164 A1, for example, discloses a paper dispenser which utilizes a conveyor belt that submerges into a tank filled with fluid that runs across an upper cylinder that is arranged directly on the underside of the paper that is to be moistened.

Using a rocker, the cylinder is either drawn away from or moved toward the paper, which provides the option of moistening the paper.

The disadvantage of the aforementioned configuration is that direct moistening of the paper sheet occurs without intermediate switching of distributing cylinders, which is associated with adding an undesirably high quantity of fluid. The paper sheet becomes so saturated due to the direct transfer of fluid from the tank to the underside of the paper sheet that—in the experience of the applicant—extraction of the paper sheet is no longer possible because it has been so thoroughly saturated that it tears upon being pulled out.

Another disadvantage of the configuration is that it lacks a conveyor mechanism for the paper sheet. It is, however, specified that the upper counter-pressure roll can be driven by motor or operated manually. But because the paper sheet has been so thoroughly saturated, trials have shown that driving a thoroughly saturated paper sheet with a rotationally driven counter-roll (directly above the moistening cylinder) is not possible. The saturated paper sheet then largely disintegrates in the drive roll gap such that an operationally secure conveyance of the paper sheet is not guaranteed.

Even manual extraction of a thoroughly saturated paper sheet from a paper dispenser is only conditionally possible because the paper sheet tends to tear at the spot where it has been moistened.

Another disadvantage of the known configuration is that it uses a fluid that evaporates. This results in the constant need to make the belt drive specified for extracting the fluid opposite the tank watertight both in active operation with the paper sheet and in the swung away position. This is supposed to prevent evaporation of the fluid from the tank—independent of the swinging movement of the rocker. It has, however, been shown that such sealing of the extraction cylinder opposite the tank cannot be executed, particularly when the extraction cylinder is insulated with gaskets and these gaskets are supposed to follow the relatively large swing path of the rocker.

Therefore the disadvantage of the aforementioned configuration is also due to the fact that the fluid placed in the tank evaporates relatively fast because the gaskets used for sealing not bring about the required sealing effect.

SUMMARY OF THE INVENTION

Furthermore, movement of the fluid using friction-loaded pressure of the paper sheet itself is supposed to occur on the conveyor belt that is used to convey the fluid. Such conveyance, however, does not function when the conveyor belt saturates the paper sheet because contact of the saturated paper belt with the cylinder conveyors is no longer sufficient to drive them in a rotating manner. For this reason, the fluid coating of the paper sheet in the disclosed document DE 34

04 164 A1 is insufficient and the problems of a manual or motor drive remain unresolved.

The task of the invention is to further develop a paper dispenser of the initially named type in such a way that a reliable conveyance of an evenly moistened paper sheet is achieved.

For purposes of completing this task, the invention is characterized by the fact that the paper dispenser has a hand-operated conveyor apparatus for conveyance of the paper sheet and that the fluid is conveyed from a extraction cylinder that submerges into the fluid bath to a transfer cylinder that unloads at the extraction cylinder, which is arranged on at least one side of the paper sheet.

With the given technical knowledge, this achieves the essential advantage of a hand-operated conveyor apparatus that has at least one extraction cylinder and on at least one transfer cylinder that unloads to the extraction cylinder.

It is advantageous that the transfer cylinder simultaneously assumes the conveyance of the paper sheet because the transfer cylinder is driven in a rotating manner by the hand-operated conveyor apparatus and is arranged on one side of the paper sheet, while the paper sheet runs over a corresponding counter pressure roll on the other side, which lies opposite the transfer cylinder.

This achieves essential advantages over the state of technology because a hand-operated conveyor apparatus achieves the advantage, for the first time, that with a corresponding hand movement both the rotating drive of the transfer cylinder and the simultaneous moistening of the paper sheet are activated, whereby a double effect upon activation of the conveyor apparatus lever is achieved.

The invention is not limited to the moistening of paper sheets made of toilet paper. The invention takes into consideration all possible paper sheets, including paper sheets with cosmetic towels that are rolled onto appropriate rolls. The invention is also suitable for towels that are stacked in a zigzag manner and extracted in the same way from a holding container by the conveyor apparatus and moved through the conveyor apparatus during moistening.

Another advantage of the invention is that, according to the position of the hand-operated conveyor apparatus, paper can be extracted from the paper dispenser either dry or moist. If the hand lever of the conveyor apparatus is not activated, there will be no rotating drive of the transfer cylinder on the paper sheet, as previously described, and the transfer cylinder coated with fluid will therefore remain elevated away from the paper sheet and the paper sheet can thereby be extracted dry from the paper dispenser by pulling on the paper belt.

On the other hand, if the lever of the conveyor device is activated the paper sheet will be simultaneously moved and moistened. The swing movement of the conveyor device lever will be transferred in a rotating manner via a cogwheel gear to the transfer cylinder and the transfer cylinder will be exposed simultaneously to the counter pressure cylinder on the housing with this swing movement (with the relatively high pressure force that is generated by the lever). This forms a tight cylinder gap through which the paper sheet is moved due to the rotation of the transfer cylinder.

At the same time the intention is that the extraction cylinder stored in the fluid bath (and in that position being at least partially submerged in the fluid) will be spring-loaded at the exterior perimeter of the transfer cylinder. This cylinder will therefore by activated upon contact by the rotating drive of the transfer cylinder and the fluid will be transferred from the exterior perimeter of the extraction cylinder to the exterior perimeter of the transfer cylinder.

Only a defined, thin layer of fluid will thereby be transferred to the paper sheet intended for moistening that is simultaneously distributed over the exterior perimeter of the transfer cylinder.

In a preferred configuration of this invention, for which separate patent protection is sought no fluid that may evaporate will be used, rather a type of oil is preferred. It has been shown that such oils do not lead to dissolution of the paper sheet in the sense of reducing its resistance to tear, but rather when such a paper sheet is soaked the resistance to tear is not noticeably reduced. This creates the advantage of the paper sheet being able to be conveyed in an operationally secure manner from the paper dispenser.

Another advantage of using oils is that there is practically no evaporation. Costly gaskets between the tank and the transfer cylinders or belts can therefore be avoided because evaporation from the oil bath can be ignored. The use of fluid in the form of oil is therefore particularly preferred.

The invention is not limited solely to oils; evaporation-resistant oil-water emulsions, oil-water-alcohol mixtures or other fluids resistant to evaporation can also be used.

Above all, white oils used in body care, such as those used in baby care, are preferred for use in the paper dispenser.

Another essential characteristic of the invention, for which independent protection is being claimed—independent of the other invention characteristics—is that the tank that holds the fluid is designed as an adapter that can be exchanged quickly.

Preferably, such a tank consists of a closed, synthetic container containing the fluid, which is hermetically sealed before being incorporated into the paper dispenser. Such a synthetic tank will be disposed in the upper portion of the paper dispenser and at least one hollow point will be arranged on the floor of the container in the direction of the bottom of the tank.

Accordingly, if the tank is used in the paper dispenser from above, the hollow point arranged on the bottom of the container will penetrate the floor of the tank and the fluid—directed by the hollow point—will run into the container. There—according to the bird bath principle—only a relatively small fluid pool will form that fills the bottom of the container. The previously mentioned extraction cylinder, which is arranged with a spring load and positioned in contact at the exterior perimeter of the transfer cylinder that is driven in a rotating manner, will submerge in this fluid pool—which is present only in a shallow layer—and the fluid will thereby transfer to the exterior perimeter of the transfer cylinder.

The configuration of an exchangeable tank, in which the fluid is contained in a sealed manner before extraction, offers the advantage that various types of fluid can be used in the paper dispenser resulting in easy exchangeability. Exchange of fluid can be performed very quickly by exchanging corresponding tanks and the tanks can be stored as a supply on-site without the risk of evaporation or deterioration of the stored fluid due to long storage times and exposure to air.

BRIEF DESCRIPTION OF THE DRAWINGS

The invention is described in greater detail using illustrations of only one manner of execution. Further characteristics and advantages of the invention are revealed by the illustrations and their descriptions.

The following is shown.

DETAILED DESCRIPTION

Figure 1:
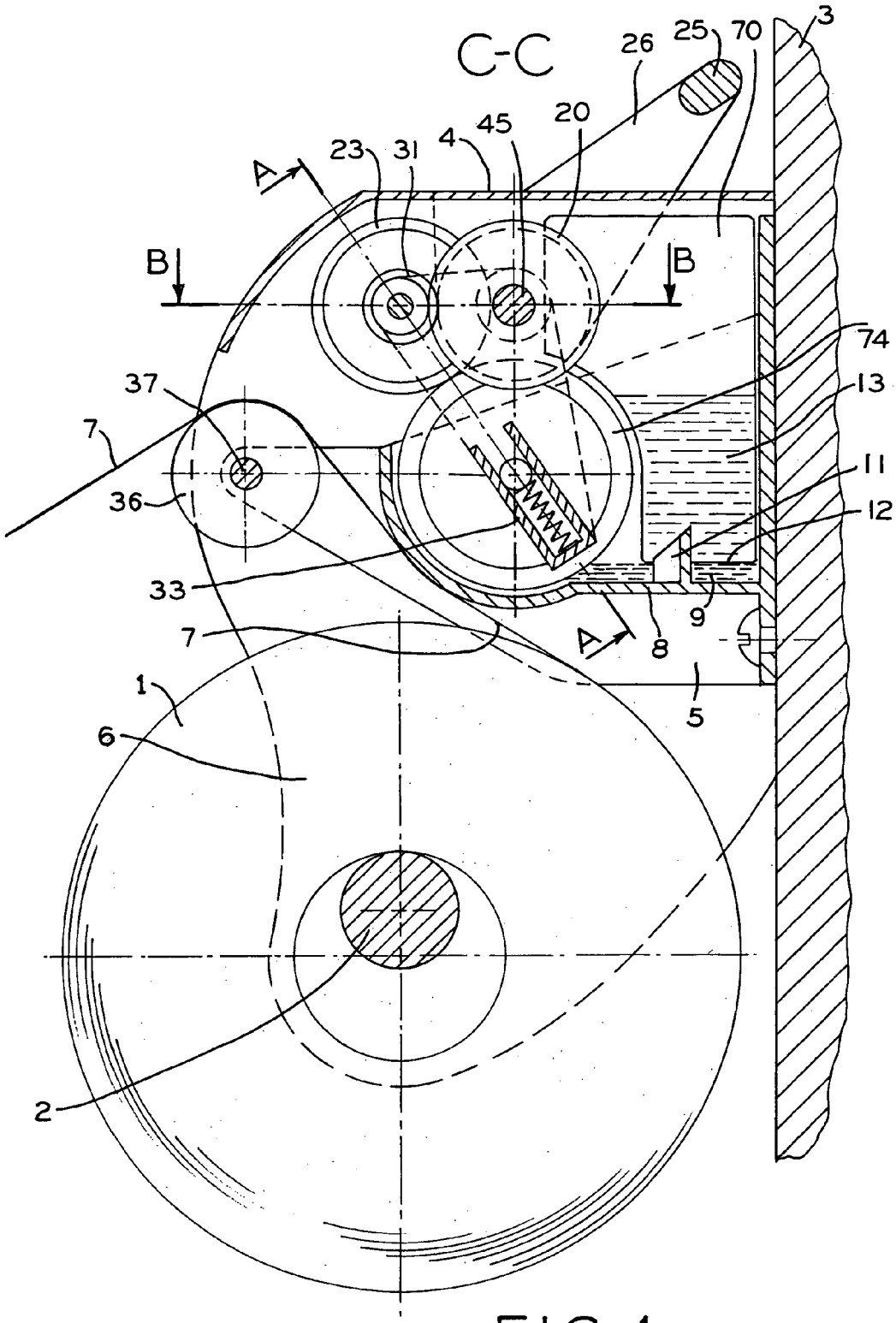
FIG. 1: Cross-section of one execution of a paper dispenser.

FIG. 1 generally displays a paper dispenser fastened with a housing 5 on a wall 3.

A side wall 6 is arranged on at least one side of the housing 5 upon which a shaft 2 is fastened on one side. A paper roll is placed from the side onto this shaft 2 so that the paper sheet 7 drawn from the paper roll 1 can be moved forward out of the paper dispenser in the arrow direction 38 (see FIG. 2).

The housing 5 can be closed upwards by a lid 4. A container 8 is built into the interior space of the housing 5 that is open on top on one side and otherwise has enclosing side walls and a closed floor panel.

A tank 10 is placed from above in the interior space of the container 8 (preferably made of a synthetic material), the bottom 12 of which is pressed onto a hollow point 11 arranged on the bottom of the container 8.

This opens the hermetic seal of the fluid 13 in the tank 10 and the fluid runs via the hollow point 11 into the interior space of the container 8 upon whose bottom a fluid pool 9 forms.

An extraction cylinder 14, which has a spring-loaded rotating axis 15 in a radial direction, is submerged in the container 8 and thereby in the fluid pool 9 that has formed there. The extraction cylinder is pressed in a radial direction against a transfer cylinder 23 arranged opposite to it that has a rotational drive.

The rotating axis 15 may be moved in a radial direction in a slit 17 of an arm 16. On one side of the rotating axis 15 is a pressure spring 18, the other end of which abuts a spring housing 33 on the arm side displayed in FIG. 1.

In this way, the extraction cylinder 14 is spring-loaded (by the pressure spring 18) against the exterior perimeter of the rotationally driven transfer cylinder 23.

The conveyor drive of the conveyor apparatus occurs through hand operation of a lever 26, upon whose front open end a grip 25 is arranged.

The lever 26 is connected to the rotary bearing 19 in a rotationally fixed manner and also connected in a rotationally fixed manner with a cogwheel 20, whereby preferably two cogwheels 20 spaced apart operate on equipped counterpart cogwheels 31. Insofar as two cogwheels are present, they are connected in a rotationally fixed manner via the connecting axle 45.

The lever is placed in the arm 16 where it can be rotated, whereby the arm 16 simultaneously forms the rotary bearing 22 for the placement of the transfer cylinder 23. The arm 16 is also connected with a casing 28 that can be formed, for example, on the arm.

The casing 28 meshes into an expanding slit 41. From an upper vertical portion of the slit 41 outward, there are two elevated receptacles 42, 43 for the casing 28 of the arm 16.

Figure 3:
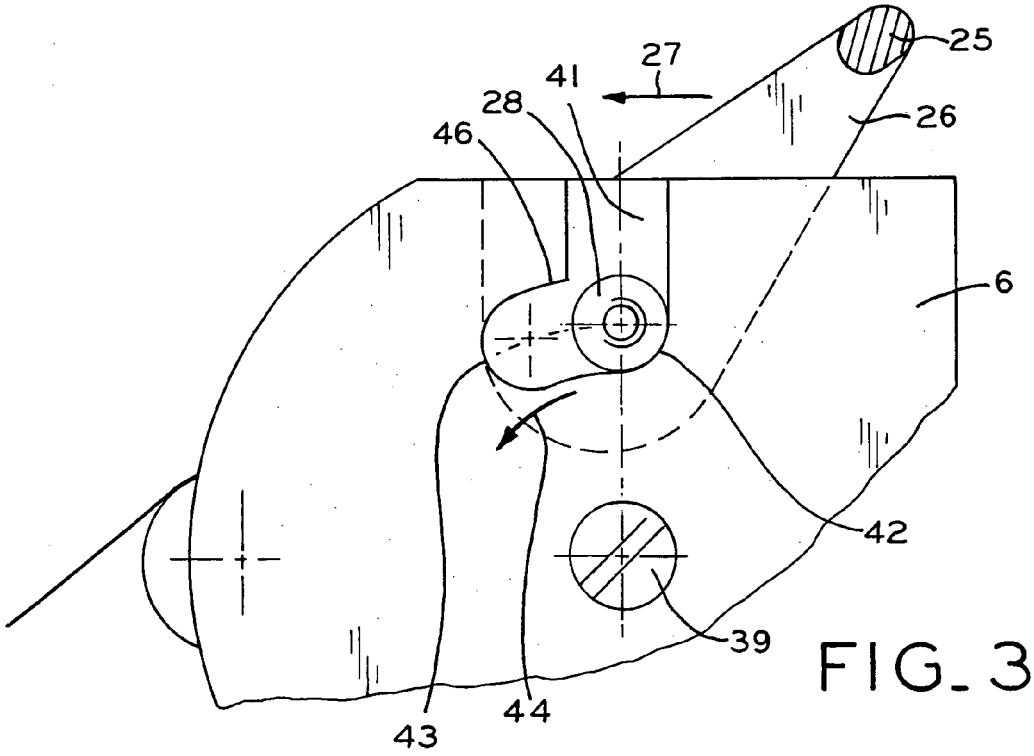
FIG. 3: Side view in arrow direction III in FIG. 4.

Insofar as the casing 28 is in the area of the receptacle 42, the lever 26 is placed in the position indicated in FIG. 3. The transfer cylinder 23 is thereby elevated from the paper sheet 7, which runs over the counter pressure cylinder 36. If the lever 26 is moved using the grip 25 in the arrow direction 27, the casing 28 on the arm 16 will lay solidly on the edge 26 of the receptacle 43 as a counter bearing. Simultaneously, the casing 28 moves from the receptacle 42 into the deeper receptacle 43 in the side wall. Due to the height difference between both receptacles 42, 43, the transfer cylinder 23 will thereby be delivered to the counter pressure cylinder 36 and placed so as to make contact with the exterior perimeter of the counter pressure cylinder (using the force of the lever arm on the lever 26) and will thereby be on the upper side of the paper sheet 7.

Figure 2:
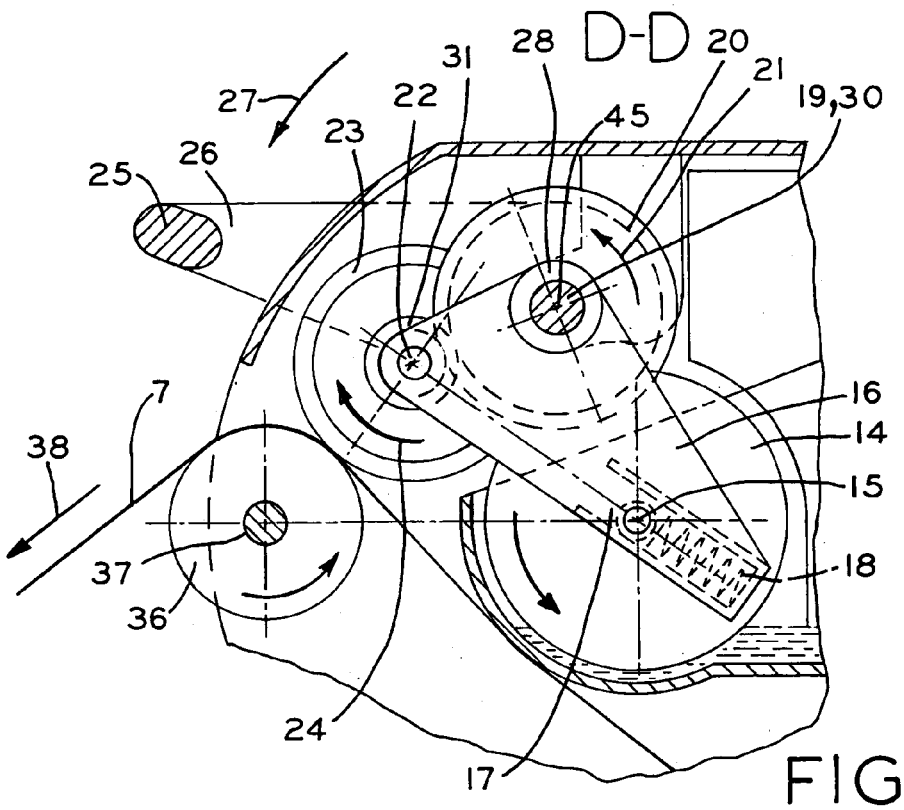
FIG. 2: Cross-section according to line D—D in FIG. 4.

FIG. 2 shows the lever 26 swung forward in the direction of the arrow 27. With the swinging of the lever, the casing 28 is placed so as to make contact with the upper edge 46 of the receptacle 43 and is locked into place there. This causes a counteracting force and further swinging of the lever against this counter bearing leads to a rotation of the axle 45 and thereby the cogwheel 20 because the cog wheel 20 is connected in a rotationally fixed manner with the axle 45.

The cogwheel 20 maintains an interlocking grip with the counterpart cogwheel 31, which is connected in a rotationally fixed manner with transfer cylinder 23.

The cogwheel 20 is thereby rotated in the arrow direction 21 and takes the counterpart cogwheel along in the arrow direction 24, which drives the transfer cylinder in a rotating manner.

The paper sheet is thereby conveyed outward in the cylinder gap between the exterior perimeter of the transfer cylinder 23 and the counter pressure cylinder 36 arranged upon it in the arrow direction 38.

The swinging path of the lever 26 can be selected in such a way that upon each swinging movement, for example, 100 mm of paper sheet is conveyed outward.

Figure 4:
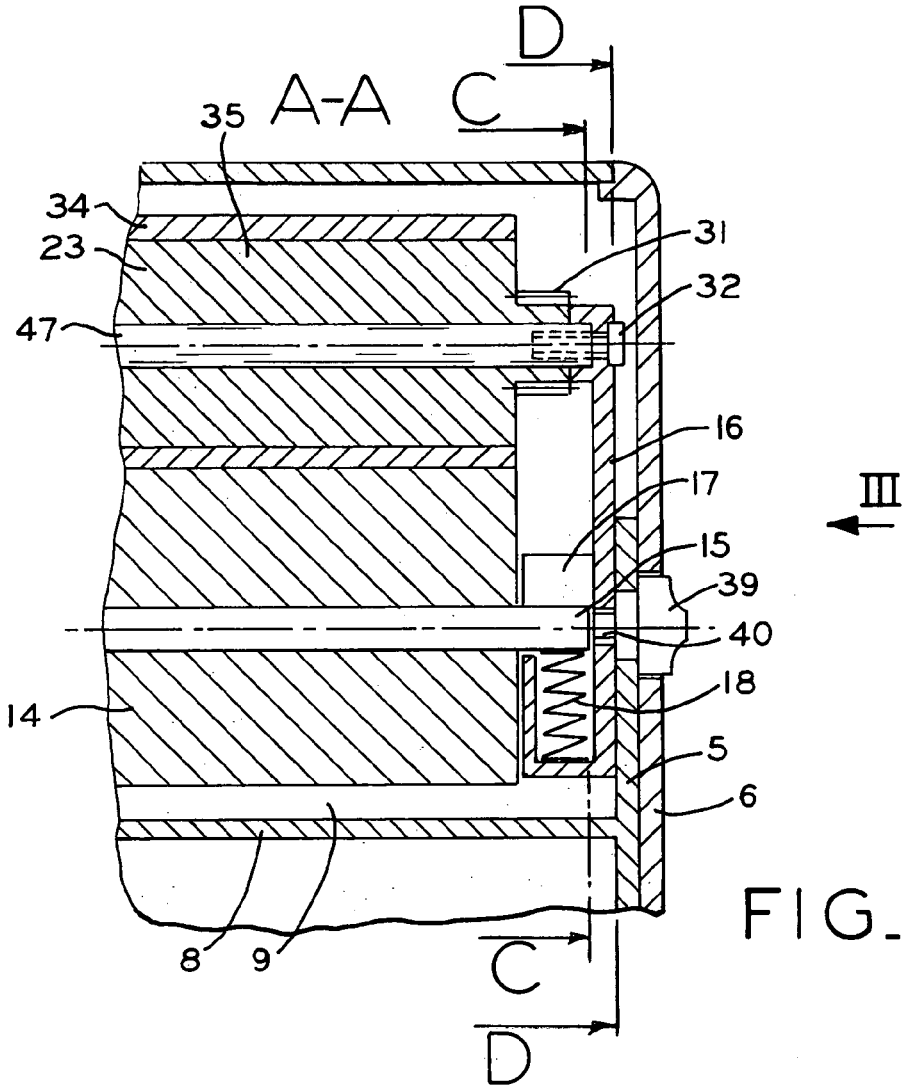
FIG. 4: Cross-section according to line A—A in FIG. 1.
Figure 5:
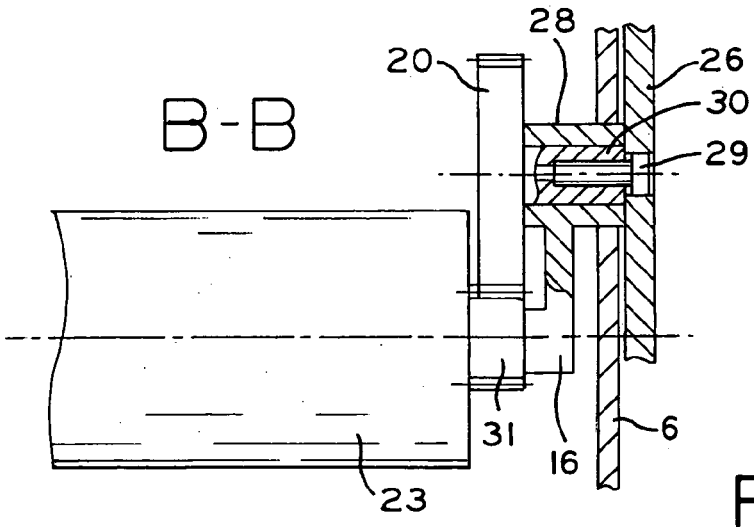
FIG. 5: Cross-section according to line B—B in FIG. 1.

The design displayed in FIG. 4 that shows only one half is symmetrical to the vertical center line so that exactly the same construction parts are on the opposite side.

FIG. 4 also shows a preferred configuration where the transfer cylinder 23 is configured as a multi-part unit. It shows a core 35 made of a harder material and casing 34 made of a softer material. In this way, the fluid extracted by the extraction cylinder 14 is simultaneously taken up by the casing 34 of the transfer cylinder 23. Furthermore, an equal coating or application of the fluid to the paper sheet is achieved through elastic suppleness of the casing 34 also in a bordered conveyor apparatus. Due to the elastic flexibility of the casing 34, unevenness in the paper sheet can still be evened out so that it can be coated evenly with a corresponding fluid application.

It is important that a controlled fluid application takes place between the extraction cylinder 14 and the transfer cylinder 23 that makes contact with it. The extraction cylinder 14 gathers only a relatively small quantity of fluid that is evenly distributed over the exterior perimeter of the extraction cylinder and transfers this fluid with a specific thickness onto the exterior perimeter of the transfer cylinder 23 which is thereby coated in measured doses. This prevents the transfer of an excessive amount to the paper sheet 7, which would lead to an undesired excess of moistening.

The entire conveyor apparatus with the lever 26 and the arm 16 is arranged in such a way that it can be removed from the paper dispenser. For this purpose a screw tap 40 is arranged on both sides of the double arm 16 into which a screw is 39 placed, which allows the entire conveyor apparatus to rotate on the side wall.

By loosening the screw 39, the entire conveyor apparatus can be lifted upward from the paper dispenser.

The counter pressure roll 36 is otherwise placed on a rotary axis that allows rotation in the side wall.

The cogwheel 20 is otherwise connected in a rotationally fixed manner with the shaft 30, which is arranged in the casing 28 so it can be rotated and is connected with the lever 26 in a rotationally fixed manner using a screw 29.

The transfer cylinder 23 is placed so it can be rotated along an axle 47, which is connected in a rotationally fixed manner with the arm 16 using a screw 32. It is also connected in a rotationally fixed manner with the counterpart cogwheel 31 and both portions are placed in the arm 16 using a screw 36 so they can rotate.

As shown in FIG. 4, the transfer cylinder 23 is connected in a rotationally fixed manner directly with the counterpart cogwheel 31.

The advantage of the paper dispenser described in the invention is that drying out is avoided by having only a small fluid pool in the container 8, whereas the largest portion of the fluid 13 is stored and protected from evaporation in the tank 10.

Special advantages are then achieved when an oil is used as the fluid because oil will not limit the tear resistance of the paper sheet.

Another advantage of the paper dispenser described in the invention is the option of extraction dry or moistened paper and that with each lever movement a specific, defined amount of paper can be gathered that can be moistened or dry, Such a paper dispenser can be set up in restrooms and in bathrooms where, for example, moistened cosmetic tissues can be used. It is also possible to arrange such a paper dispenser at baby changing stations—even in vehicles—to be able to make moistened paper available over a long period of time without the risk of drying out.

The hand-operated conveyor apparatus described in the invention yields several advantages simultaneously.

1. With movement of the lever 26, the transfer cylinder 23 is pressed with great force against the counter-pressure cylinder 36 to form a pinch gap so that the paper sheet in the cylinder pinch gap between both cylinders is seized with a significant pressure force.

2. This delivery movement also activates the rotation drive for the transfer cylinder 23.

3. The moistening of the paper sheet occurs in the area of the transfer cylinder 23 that is driving the paper sheet so that the risk of tearing the paper sheet is reduced or completely eliminated.

Paper sheets of one ply or several ply can be used, in particular single ply or multiple ply toilet paper.

Trials have shown that even thin, single-ply toilet paper can be conveyed without difficulty because the conveyor apparatus described in the invention (transfer cylinder 23 drive) that makes contact directly on the top side of the paper sheet makes smooth conveyance possible because the transfer cylinder simultaneously takes over the moistening of the paper sheet.

Therefore there are no uneven spots of moisture and the paper sheet transport is not separate from the moistener.

It is preferable that the material of the housing be made of a synthetic material because such a housing can be mass-produced in great quantities at a low per-unit cost.

A paper dispenser of this type is therefore well suited to replace existing paper dispenser sin restrooms.

| Illustration Legend | |
|---|---|
| 1 | Paper Roll |
| 2 | Shaft |
| 3 | Wall |
| 4 | Lid |
| 5 | Housing |
| 6 | Side wall |
| 7 | Paper sheet |

-continued

| Illustration Legend | |
|---|---|
| 8 | Container |
| 9 | Fluid pool |
| 10 | Tank |
| 11 | Hollow point |
| 12 | Bottom |
| 13 | Fluid |
| 14 | Extraction cylinder |
| 15 | Rotating axis |
| 16 | Arm |
| 17 | Slit |
| 18 | Pressure spring |
| 19 | Rotating axis |
| 20 | Cogwheel |
| 21 | Arrow direction |
| 22 | Rotary bearing |
| 23 | Transfer cylinder |
| 24 | Arrow direction |
| 25 | Grip |
| 26 | Lever |
| 27 | Arrow direction |
| 30 | 28 Casing |
| 29 | Screw |
| 30 | Shaft |
| 31 | Counterpart cogwheel |
| 32 | Screw |
| 35 | 33 Spring housing |
| 34 | Casing |
| 35 | Core |
| 36 | Counter pressure cylinder |
| 37 | Rotating axis |
| 40 | 38 Arrow direction |
| 39 | Screw |
| 40 | Screw tap |
| 41 | Slit |
| 42 | Receptacle |
| 45 | 43 Receptacle |
| 44 | Arrow direction |
| 45 | Axel |
| 46 | Edge |
| 47 | Axel |

The invention claimed is:

1. A paper dispenser for the optional dispensing of saturated or dried paper from a paper roll or a folded paper sheet, said dispenser comprising:

a housing in which a container containing a bath of fluid is disposed and from which fluid will be conveyed against a paper sheet to be moistened;

a hand-operated paper feed conveyor device including a transfer cylinder disposed on one side of the paper sheet and a counterpressure cylinder disposed opposite said transfer cylinder on the other side of the paper sheet, whereby when the transfer and pressure cylinders are pressed together they form a pinch gap;

an extraction cylinder at least partially submerged in the fluid bath and in contact with a cylindrical surface of the transfer cylinder;

the conveyor device including a swingable lever rotatably drivingly connected via a cogwheel gear to said transfer cylinder and connected to said transfer cylinder to move the transfer cylinder into pressure contact with said counterpressure roll whereby the paper sheet is conveyed through said pinch gap formed between said transfer cylinder and counterpressure cylinder.

2. The paper dispenser as defined in claim 1 wherein the transfer cylinder simultaneously executes the conveyance of the paper sheet.

3. The paper dispenser as defined in claim 1 wherein activation of the lever on the conveyor device engages a rotary drive of the transfer cylinder and simultaneously moves the transfer cylinder toward the counterpressure cylinder thereby causing moistening of the paper sheet.

* * * * *